US006915927B2

(12) United States Patent
Stukas

(10) Patent No.: US 6,915,927 B2
(45) Date of Patent: Jul. 12, 2005

(54) DROPPER CAP

(75) Inventor: Vidas Stukas, Victoria (CA)

(73) Assignee: Seastar Chemicals Inc., Sidney (CA)

( * ) Notice: Subject to any disclaimer, the term of this patent is extended or adjusted under 35 U.S.C. 154(b) by 210 days.

(21) Appl. No.: 10/334,801

(22) Filed: Jan. 2, 2003

(65) Prior Publication Data

US 2004/0129738 A1 Jul. 8, 2004

(51) Int. Cl.[7] ..... B65D 25/48

(52) U.S. Cl. ..... 222/189.06; 222/189.07; 222/420; 222/546; 222/547; 222/568; 222/571

(58) Field of Search ..... 222/189.06, 189.07, 222/420, 546, 547, 568, 571

(56) References Cited

U.S. PATENT DOCUMENTS

| | | | | | |
|---|---|---|---|---|---|
| 862,420 | A | * | 8/1907 | Thompson | 222/189.07 |
| 1,255,779 | A | * | 2/1918 | Oesch | 222/189.07 |
| 3,047,195 | A | * | 7/1962 | Richmond | 222/570 |
| 3,926,348 | A | * | 12/1975 | Lutzker | 222/189.07 |
| 3,980,211 | A | | 9/1976 | Owens | |
| 4,531,657 | A | * | 7/1985 | Saito et al. | 222/108 |
| 4,600,131 | A | | 7/1986 | Roof et al. | |
| 4,928,861 | A | * | 5/1990 | Schiemann | 222/481.5 |
| 5,246,145 | A | | 9/1993 | Leoncavallo et al. | |
| 5,358,151 | A | | 10/1994 | Strasenburgh | |
| 5,573,144 | A | * | 11/1996 | Steib et al. | 222/189.08 |
| 5,938,087 | A | * | 8/1999 | Randall | 222/547 |
| 6,045,014 | A | * | 4/2000 | Marino | 222/546 |
| 6,045,540 | A | * | 4/2000 | Cross | 604/256 |

* cited by examiner

*Primary Examiner*—Kenneth Bomberg
(74) *Attorney, Agent, or Firm*—Paul Smith Intellectual Property Law; Paul Smith; C. Larry Kyle

(57) ABSTRACT

An improved dropper cap, for use in controlled dispensing of liquid from a container, comprises an antechamber, a baffle and an elongated nozzle. The nozzle may comprise a flared spout to ensure clean separation of the liquid from the dropper cap, reducing dripping and smearing of the liquid on the dropper cap, as well as precise dispensing of the liquid. The baffle physically prevents splashing of the liquid from the container, and includes openings to control the flow of liquid into the nozzle. The baffle and antechamber cooperate to draw back undispensed liquid from the nozzle and prevent spurting of the liquid from the container between uses. Further, the dropper cap is threaded to allow easy attachment and removal from the container.

26 Claims, 2 Drawing Sheets

DROPPER CAP

FIELD OF THE INVENTION

This invention relates to a dropper cap for the controlled dispensing of liquids from an associated liquid container at a controlled flow rate, from individual droplets through the flow range to a steady stream, in a controlled and neat fashion, without spillage or contamination of the liquid.

BACKGROUND OF THE INVENTION

Liquids are dispensed from liquid containers in a variety of means, depending upon the physical properties of the liquid being poured and on the ease and/or accuracy of dispensing being sought. The dispensing means ranges from the ubiquitous mustard dispenser or liquid dishwashing detergent dispenser to those used in the laboratory dispensing hazardous chemicals of an ultrapure nature. Amounts dispensed vary from single droplets to a steady stream. Their complexity varies from the plastic caps seen on household goods to mechanical pumps found in laboratories, which are devices that are typically based upon some form of piston and valve assembly. How well they dispense is in the eye of the consumer, be it the tolerance for the smear of excess material on the cap associated with a squeeze mustard or dishwashing soap container, to the precise demands of the analytical chemist who may worry about any wayward droplets of hazardous materials or contamination by foreign material. Also of importance is the ease with which the cap can be removed to allow cleaning and subsequent disposal. In the present invention, liquids can be easily dispensed in a drop-like or stream-like manner, while also being neatly and safely contained within the environs of the spout in a noncontaminating fashion. The present invention is also easily unscrewed, facilitating cleanup and disposal.

The current modes of dispensing liquids from containers vary from simply pouring—which is inaccurate and gross volumetrically—to elaborate mechanical dispensers based upon a calibrated piston and check valves—which dispense accurately, but invariably contaminate the product through the particles produced by wear. In between these extremes lies a variety of 'drop' dispensing style of caps such as those shown in FIG. 1.

The Yorker Spout Cap (FIG. 1A) is one of the simplest devices, typically seen on ketchup or mustard containers and in glue dispensers. The straight taper of the spout allows a ready stream of liquid to be squeezed out, making it ideal for viscous liquids like ketchup and mustard. The tapered spout allows some drawback of the liquid from the zone near the orifice, but can leave significant globules in the orifice itself or in the immediate vicinity, depending upon viscosity of the liquid. The common result is dribbling and spurting of material held up in the spout area. The small, snap-on cap exacerbates the smear.

The Snap-Top Cap (FIG. 1B), in contrast, has a very short (typically 2–4 mm) pour spout. This short spout tends to promote dribbling and smearing, particularly for viscous or runny fluids. Flaring or shaping the spout reduces, but does not eliminate, the dribbling. The height of this pour spout is limited by the geometry of the hinged lid. The sealing plug approaches at an angle to the orifice, requiring looser tolerances, which in turn promotes leakage and smearing of the contents over the cap. A lack of mechanical advantage in effecting the closure aggravates the leakage. This type of cap is often seen on household cleaners and shampoo bottles.

The common Eye Dropper cap (FIG. 1C) has an extended pour spout with a rounded end. The latter helps avoid damage to the eye. However, the rounded shape of the tip also promotes dribbling or smearing of the liquid being dispensed—this is desirable for coverage over the cornea, but not for clean and precise dispensing of droplets.

The Stull Twist Cap (FIG. 1D) and the Pull & Push Cap (FIG. 1E) both have a central shaft and a captive, outer cap which combine together to effect a seal. The gap between the shaft and the outer cap tends to trap material. Material left behind on the tip of the central shaft leads to smearing of the contents, or forms an undesirable, dried residue. The Stull Twist cap has a more sharply defined tip, allowing droplets to be formed in a more discrete manner than the rounded version in the Pull & Push cap. However, both types of cap tend to leak or smear material as the cap used to seal the orifice is pushed or rotated downwards. The Stull Twist cap is usually seen on mustard/ketchup bottles; the Pull & Push cap, on liquid dish soap containers.

The Flip-Up Spout (FIG. 1F) and the Disc Top cap (FIG. 1G) have similarly hinged pour spouts. The gaps around these spouts tend to accumulate excess material and thereby trap contaminants. The straight, unoccluded bores of these spouts are limited both in the fineness and in the control of the droplets dispensed. The blunt or squared off ends of the pour spouts also tend to encourage dribbling. This type of cap is often seen on shampoo bottles.

The 'JT Baker' dropper cap (FIG. 1H) is used exclusively by JT Baker Co and its distributors for laboratory solutions and acids. It uses a snap-in cap for attachment to the bottle. It has a well-formed nozzle with a relatively small flare to the pour spout. A hanging basket type of baffle with rectangular holes extends inwards. Also, the sizing of the nozzle and the nature of the baffle encourage the dispensing of two or more discrete droplets, rather than single ones in less viscous liquids. The JT Baker Cap has no antechamber that acts via surface tension to draw back liquid entrained in the nozzle. Relatively large openings, which encourages the dispensing of larger volumes or multiple droplets, are used in the baffle to allow liquid to drain back, rather than the pull exerted by liquid in an antechamber as in the present invention. The snap-in cap can be easily damaged during installation, causing leakage. The snap-in cap also creates a handling and environmental problem in rinsing the residual container contents when the empty container is disposed of. Finally, the snap-in cap can occlude foreign material, possibly contaminating the product.

The 'Merck' dropper cap (FIG. 1I) is used by Merck KGaA and its subsidiaries for laboratory solutions and acids. This snap-in type of cap has a nozzle with a straight bore and a blunt tip, which allows liquid to dribble down the spout. The unobstructed spout has a separate vent and drip control extension on the inside. No baffling is in place to prevent any spit back of liquid resulting, for example, from a container being placed abruptly on a hard surface. The use of a fixed vent requires a fixed direction or orientation (indicated on the spout) for pouring. Otherwise, the vent is occluded. The comments above on the drawbacks of snap-in caps also apply to the Merck cap.

SUMMARY OF THE INVENTION

The improved dropper cap according to the invention provides better and finer control of the droplet size while maintaining the ability to dispense in a stream-like fashion. The minimum drop size dispensed is also much finer in the present invention than in the prior art caps. All of the liquid is dispensed precisely and is contained neatly and safely, and the invention can dispense single droplets, even in less viscous liquids.

No material is allowed to dribble over the spout and any liquid not fully dispensed will be drawn back into the cap itself without contaminating the liquid. Liquid left behind on the exterior of the pour spout might otherwise be subject to airborne contamination or contamination from subsequent handling.

Mechanical moving parts, such as hinged, flip up spouts, are avoided to prevent trapping or buildup of contaminants while reducing the risk of leakage, particularly for less viscous liquids. Eliminating mechanical parts also minimizes contamination associated with wear particles while further reducing the wetted surface area.

The present invention is easily removed from the liquid container, facilitating cleanup and disposal when the container is empty. A separate removable closure or 'dust cap' is used to seal the spout for transport.

In one aspect, the invention comprises a liquid dispensing cap for use with a container. The cap comprises a chamber having an open inlet end and an outlet end. The cap is adapted to attach to a container. The chamber is defined by a cylindrical wall and a top surface. The cylindrical wall terminates in a free end at the inlet end and is connected to the top surface at the outlet end. The top surface defines an antechamber opening at the outlet end. An antechamber is defined by cylindrical antechamber wall extending from the top surface at the antechamber opening away from the chamber to an upper surface. The upper surface defines a nozzle opening. A nozzle portion has an inlet end at the nozzle opening and an outlet end. The nozzle is defined by a cylindrical nozzle wall extending from the upper surface at the nozzle opening to the outlet end. A baffle is provided between the outlet end of the antechamber and the inlet end of the nozzle. The diameter of the antechamber is less than the diameter of the chamber.

In a further aspect, the cap has a flared spout on the outlet end of the nozzle. In yet a further aspect, the nozzle has an inner wall defining a passageway and the flared spout defines an angle of between 30 and 60 degrees in relation to the inner wall.

In another aspect, the diameter of the antechamber may be approximately 1 to 3times the diameter of the nozzle.

In yet another aspect of the invention, the baffle is rigidly associated with and extends across the inlet end of the nozzle, extending laterally from the inner wall of the nozzle. The baffle may have a plurality of openings that may be round or rectangular in shape. Each of the opening or openings may have a diameter less than the diameter of the nozzle.

A removable dust cap is adapted to form a seal over the outlet end of the nozzle. A plug mounted within the dust cap forms a seal by insertion of the plug into the outlet end of the nozzle.

In another aspect, the invention comprises a threaded element in the chamber between the inlet end and the outlet end of the chamber.

In yet another embodiment, the invention comprises a liquid dispensing cap for use with a container, comprising a wall defining the sides of a chamber having an open first end and an open-ended antechamber located at a second end of the chamber. The antechamber defines a smaller volume than the volume defined by the chamber. A nozzle has an inlet end in fluid communication with the antechamber and an outlet end. In a further aspect of the invention, the wall may include threads.

In further aspect of the invention, the invention may comprise a protrusion, extending into the chamber in spaced relation with the wall defining the sides of the chamber. The protrusion acts as an annular sealing ring when the cap is installed on a container.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred and alternative embodiments of the invention will be described by references to the accompanying drawings, in which.

DETAILED DESCRIPTION OF THE PREFERRED EMBODIMENT OF THE INVENTION

Figure 1A:
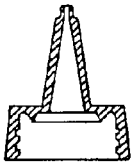
Fig. 1A (Prior Art)
FIG. 1 shows a cross sectional view of alternative prior art drop dispensing caps.
Figure 1B:
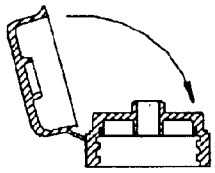
Fig. 1B (Prior Art)
Figure 1C:
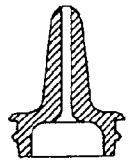
Fig. 1C (Prior Art)
Figure 1D:
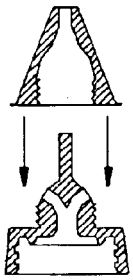
Fig. 1D (Prior Art)
Figure 1E:
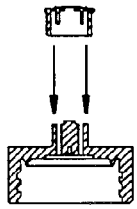
Fig. 1E (Prior Art)
Figure 1F:
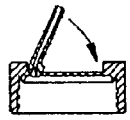
Fig. 1F (Prior Art)
Figure 1G:
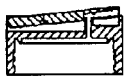
Fig. 1G (Prior Art)
Figure 1H:
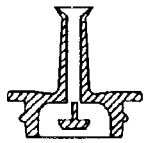
Fig. 1H (Prior Art)
Figure 1I:
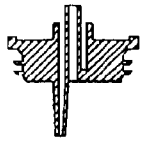
Fig. 1I (Prior Art)
Figure 2:
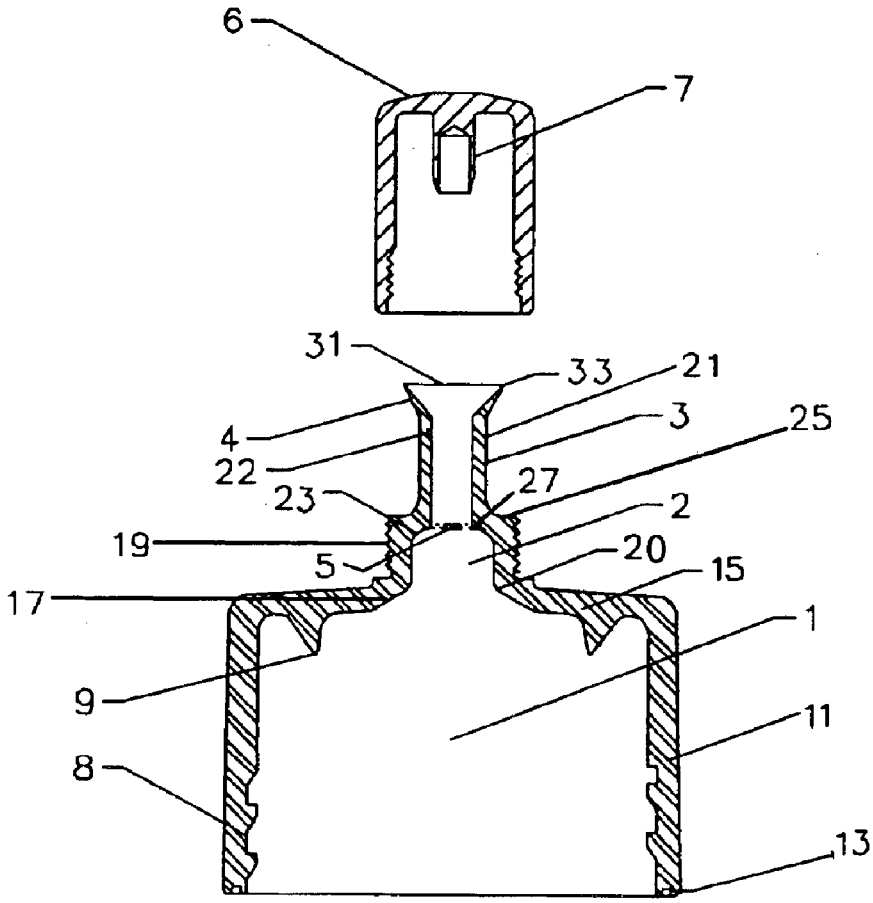
FIG. 2 shows a cross sectional view of the preferred embodiment of the present invention.

FIG. 2 shows the preferred embodiment of the present invention. The preferred embodiment includes a chamber 1 defined by a substantially cylindrical chamber wall 11 and a top surface 15. At one end, cylindrical chamber wall 11 is contiguous with the top surface 15, while at the opposite end it terminates as a free end 13 forming the first open, inlet end of chamber 1. Top surface 15 extends radially inward from the cylindrical chamber wall 11 and defines an antechamber opening 20 at a second, outlet end of chamber 1. The inner surface of cylindrical chamber wall 11 is provided with a threaded element 8 for attachment to a container. The diameter of the chamber 1 is slightly larger than the top of the container, such that the cap fits snugly over the top of the container. The container is typically of the form of a plastic bottle with a flexible wall.

An open-ended antechamber 2 is defined by a cylindrical antechamber wall 19 and upper surface 25. From antechamber opening 20, cylindrical antechamber wall 19 extends from the top surface 15 away from the chamber 1 to the upper surface 25 at an outlet end of the antechamber 2. Preferably the antechamber opening 20 has a beveled surface 17 in the transition from top surface 15 to cylindrical antechamber wall 19. Upper surface 25 extends radially inward from cylindrical antechamber wall 19 and defines a nozzle opening 27. Preferably, the antechamber 2 has a rounded upper edge 23 where the cylindrical antechamber wall 19 joins with upper surface 25. The volume and diameter of the antechamber 2 are each less than the volume and diameter respectively defined by the chamber 1.

A cylindrical protrusion 9 extending from the top surface 15 into the chamber 1, in spaced relation to the cylindrical chamber wall 15, acts as a sealing ring, serving to prevent leakage of the liquid in a container when the cap is installed on the container, even if the container is turned upside down. It will be understood that the exact geometry of the protrusion 9 is selected to correspond to the top lip of the chosen container.

The antechamber 2 is in fluid communication with the nozzle opening 27 at the inlet end of a nozzle 3. The elongated length of the nozzle 3 is defined by a cylindrical nozzle wall 21 extending from the upper surface 25 away from antechamber 2, the inner surface 22 of which forms a passageway through which the liquid flows to the outlet end 31 of the nozzle 3. The outlet end 31 of the nozzle terminates in a pour spout 4 with a flared, sharp-edged lip 33 formed thereupon. The liquid being dispensed therefore flows from the liquid container, through the chamber 1, into the relatively smaller antechamber 2 by way of antechamber opening 20, into the nozzle opening 27 at the inlet end of the nozzle 3 and out the spout 4. The shape of the sharply flared and angled spout 4 helps form the liquid into a small sphere or droplet by surface tension and prevents the smearing effect of liquid dribbled over the edge of the spout 4. The spout 4 flares away from the passageway defined by the inner wall 21 of the nozzle at an angle of approximately between 30 and 60 degrees, thereby containing the droplet in a small, well-formed ball. The preferred embodiment of the invention contains a spout slope of approximately 40 degrees. A squared off tip with no flare, or even with a small flare, allows liquid to dribble down the side of the spout 4 and nozzle 3. A sharp edge helps break the effects of surface tension as the droplet loses contact with the edge of the lip 33, allowing the entire droplet to leave whole.

Figure 3:
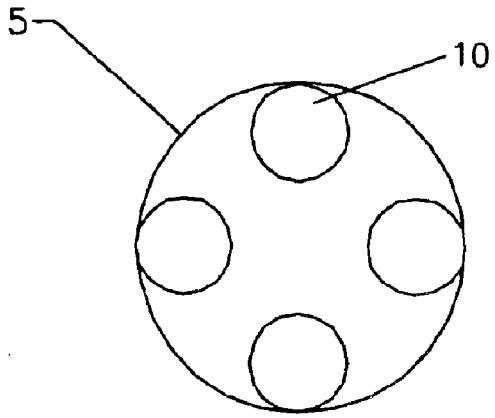
FIG. 3 shows a plan view of the baffle of the present invention.

Between the outlet end of the antechamber 2 and the nozzle 3 is a baffle 5, rigidly associated with the nozzle opening 27 at the inlet end of the nozzle 3 and extending laterally from the inner wall 21 of the nozzle to extend directly across the entire nozzle inlet. The baffle 5 further comprises at least one opening 10 through which liquid may flow. The number and geometry of the openings 10 in the baffle 5 controls the minimum size of the droplet formed, whether one or multiple droplets is formed, as well as the ease with which each droplet can be controlled. The configuration of the openings 10 also limits how high a continuous stream flow rate can be formed. For example, 6 round holes of 0.026" diameter will allow a single, 0.03 g droplet of water to be dispensed easily while 4 rectangular holes of 0.06" ×0.1" tend to allow larger droplets as well as doublets of 0.05 g to 0.1 g to be formed sporadically. In the preferred embodiment of the invention, the baffle contains 4 round openings 10, each of 0.046" (just under 3/64") diameter, as shown in FIG. 3. It will be understood that the exact preferred size and geometry of the opening or openings in the baffle will depend on the particular liquid being dispensed in a given application.

The baffle 5 also helps make the liquid more manageable when dispensing in a continuous stream. The relatively large (7/64" to 11/64") diameter of the nozzle 3 compared to the diameter of the holes in the said baffle 5 allows liquid to hang up therein even when the container is completely inverted. A relatively small (5/64" or less) diameter nozzle bore, as defined by the inner walls of the nozzle, would continue to draw watery liquid from the container in an unwanted fashion via the effects of capillary action or surface tension. In the preferred embodiment of the invention, a round nozzle bore of 10/64" diameter was used. Generally, the diameter of the nozzle bore is uniform throughout the length of the nozzle.

The baffle 5 has a further function in acting as a shield to minimize the tendencies of liquids to spurt up unwanted droplets, whenever a container is quickly inverted for the dispense phase, or when it is placed down sharply. The action of the standing wave in the contents of the container launches any droplets formed in this manner towards the mouth. In the present invention, the baffle 5 blocks these droplets.

After the dispense phase, any liquid remaining in the nozzle 3 is drawn back past the baffle 5 into the antechamber 2, into the chamber 1, thereby clearing the said baffle 5 of liquid and allowing the container to vent without spurting. The nozzle 3 is sealed for transport by a removable dust cap 6. In the preferred embodiment of the invention, the dust cap 6 is adapted to effect a seal with the nozzle 3 by insertion of a hollow plug 7 into the outlet end of the nozzle 3.

The present invention therefore uses the geometry of the device to control the effects of liquid surface tension so that the dispense phase, as well as the return of any remaining liquid, is performed neatly, cleanly and safely.

The liquid is initially dispensed during either the inversion of the container using gravity as the driving force, or by squeezing the container while holding it at a lesser angle. The liquid is therefore pushed or allowed to gravity feed from the container through the chamber 1 into the small antechamber 2, through the openings in the baffle 5, and out via the nozzle 3 past the sharply defined lip of the pour spout 4. This sharp demarcation between the nozzle 3 and the pour spout 4 allows the formation of well-shaped droplets.

After the liquid has been dispensed, any liquid in the spout 4 and nozzle 3 needs to be drawn back in to prevent subsequent dribbling and spurting, as well as to vent the container. This also reduces the likelihood of contamination of the liquid by airborne particles, or particles produced by the wear of moving parts.

The volume of the antechamber 2 is selected to draw the liquid trapped in the nozzle 3 back into the body of the container. This entrained liquid is drawn down through the holes in the baffle 5 using both the pull of gravity and the surface tension effects of the slightly larger antechamber 2 so that a contiguous globule is momentarily formed in the antechamber 2 along rounded upper edge 23. As the diameter of the antechamber 2 is smaller than the diameter of the chamber 1, the effects of surface tension are broken by the sudden expansion in diameter below the antechamber 2 and the globule falls back into the container. These actions clear the holes in the baffle 5 and clear the bore of the nozzle 3, allowing venting of the container. The diameter of the antechamber 2 can vary from about 1 to 3 times the diameter of the nozzle 3 for liquids with surface tension similar to water. The preferred embodiment of the invention uses an antechamber diameter of 5/16", approximately twice the diameter of the nozzle bore.

In addition, the present invention prevents the holdup of liquid in the spout 4 area, which in turn prevents liquid being spat back out during any inadvertent squeezing of the container. Moreover, the location of the antechamber 2 minimizes the volume held by the nozzle 3 while effectively lengthening the distance from the cap's surface to the tip of the pour spout 4. This increased length allows better control of the pour.

It will be appreciated by those skilled in the art that while the preferred embodiment of the invention has been described in detail, variations to the preferred embodiment may be practised without thereby departing from the scope of the invention, which scope is reflected in the foregoing disclosure and in the following claims.

The embodiments of the present invention in which an exclusive property or privilege is claimed are defined as follows:

1. A liquid dispensing cap for use with a container, comprising:

a chamber having an open inlet end and an outlet end, adapted to attach to a container, said chamber defined by a cylindrical chamber wall and a top surface, said cylindrical wall terminating in a free end at said inlet end and connected to said top surface at said outlet end, said top surface defining an antechamber opening at said outlet end;

an antechamber defined by a cylindrical antechamber wall extending from said top surface at said antechamber opening away from said chamber to an upper surface, said upper surface defining a nozzle opening;

a nozzle having an inlet end at said nozzle opening and an outlet end, said nozzle defined by a cylindrical nozzle wall extending from said upper surface at said nozzle opening away from said antechamber to said outlet end;

a baffle, said baffle being located across said nozzle opening between said antechamber and said nozzle;

and wherein the diameter of said antechamber is less than the diameter of said chamber.

2. The liquid dispensing cap of claim 1 further comprising a flared spout on the outlet end of said nozzle.

3. The liquid dispensing cap of claim 2 wherein said nozzle has an inner wall defining a passageway and said flared spout defines an angle of between 30 and 60 degrees in relation to said inner wall.

4. The liquid dispensing cap of claim 1 wherein the diameter of said antechamber is larger than the diameter of said nozzle.

5. The liquid dispensing cap of claim 4 wherein said diameter of said antechamber is approximately less than 3 times the diameter of said nozzle.

6. The liquid dispensing cap of claim 1 wherein said baffle further comprises a baffle opening.

7. The liquid dispensing cap of claim 6 wherein said baffle opening is round in shape.

8. The liquid dispensing cap of claim 7 wherein said baffle opening has a diameter less than the diameter of said nozzle.

9. The liquid dispensing cap of claim 1 or 6 wherein said baffle extends laterally from an inner wall of the nozzle and extends directly across the inlet end of the nozzle.

10. The liquid dispensing cap of claim 1 further comprising a removable dust cap adapted to form a seal over the outlet end of said nozzle.

11. The liquid dispensing cap of claim 10 wherein a plug is mounted within said dust cap and said seal is formed by insertion of said plug into the outlet end of said nozzle.

12. The liquid dispensing cap of claim 11 wherein said plug is hollow and open at one end.

13. The liquid dispensing cap of claim 1 wherein said chamber comprises a threaded element between said inlet end and said outlet end of said chamber.

14. A liquid dispensing cap for use with a container, comprising:

a wall defining the sides of a chamber having an open first end;

an open-ended antechamber located at a second end of and externally to said chamber, said antechamber defining a smaller volume than the volume defined by said chamber; and, a nozzle having an inlet end in fluid communication with said antechamber and an outlet end, said nozzle being located externally to said antechamber formed and terminating in a pour spout with a flared sharp edged lip formed thereupon, said antechamber being located between said nozzle and said chamber.

15. The cap of claim 1 or 14 further comprising a protrusion extending into said chamber in spaced relation with said wall, wherein said protrusion acts as an annular sealing ring when the cap is installed on said container.

16. The cap of claim 14 further comprising a baffle extending laterally from an inner wall of the nozzle and extending directly across said inlet end of said nozzle.

17. The cap of claim 14 further comprising a baffle extending laterally from an inner wall of the nozzle and extending directly across said inlet end of said nozzle.

18. The liquid dispensing cap of claim 14 wherein said nozzle has a diameter that is less than the diameter of said antechamber.

19. The liquid dispensing cap of claim 1 wherein said antechamber has a rounded upper edge.

20. The liquid dispensing cap of claim 19 wherein said rounded upper edge is located where said second end of said cylindrical antechamber wall is connected to said upper surface.

21. The liquid dispensing cap of claim 1 wherein said antechamber opening has a beveled edge.

22. The liquid dispensing cap of claim 21 wherein said antechamber has a rounded upper edge where said second end of said cylindrical antechamber wall is connected to said upper surface.

23. The liquid dispensing cap of claim 1 wherein said nozzle has a diameter of between 7/64" to 11/64".

24. The liquid dispensing cap of claim 1 wherein said nozzle has a diameter of 10/64".

25. The liquid dispensing cap of claim 8 wherein said diameter of said baffle opening being between 0.026" to 0.046 ".

26. The liquid dispensing cap of claim 25 wherein said diameter of said nozzle being between 7/64" to 11/64".

* * * * *